US007470899B2

(12) United States Patent
Atherton et al.

(10) Patent No.: US 7,470,899 B2
(45) Date of Patent: Dec. 30, 2008

(54) PLURAL BORE TO SINGLE BORE ION TRANSFER TUBE

(75) Inventors: Paul R Atherton, San Jose, CA (US); Jean Jacques Dunyach, San Jose, CA (US); Maurizio Splendore, Walnut Creek, CA (US); Eloy R. Wouters, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 210 days.

(21) Appl. No.: 11/641,451

(22) Filed: Dec. 18, 2006

(65) Prior Publication Data

US 2008/0142698 A1 Jun. 19, 2008

(51) Int. Cl.
*H01J 49/26* (2006.01)

(52) U.S. Cl. ..... 250/288

(58) Field of Classification Search ..... 250/288, 250/281, 282

See application file for complete search history.

(56) References Cited

U.S. PATENT DOCUMENTS 5,157,260 A 10/1992 Mylchreest et al.
6,066,848 A 5/2000 Kassel et al.
6,583,408 B2 6/2003 Smith et al.
6,667,474 B1 12/2003 Abramson et al.
6,803,565 B2 10/2004 Smith et al.
7,060,976 B2 * 6/2006 Sheehan et al. ..... 250/288
7,351,960 B2 * 4/2008 Belford ..... 250/288
2002/0121596 A1 9/2002 Laiko et al.
2006/0186329 A1 8/2006 Gebhardt et al.
2006/0255264 A1 11/2006 Belford

* cited by examiner

*Primary Examiner*—Kiet T Nguyen
(74) *Attorney, Agent, or Firm*—David E. Allred; Charles B. Katz

(57) ABSTRACT

An ion source includes an ion transfer tube having two segments for transporting a sample fluid containing ions between a first chamber and a second chamber maintained at a reduced pressure relative to the first chamber. A first segment may include a plurality of channels and heat conductive walls forming the plurality of channels. The plurality of channels and walls forming the channels promote efficient convective heat transfer to the sample fluid, thereby enabling operation at relatively high sample fluid flow rates, resulting in an increase in the number of ions that may be delivered to a mass analyzer. A second segment forms a single common channel that receives a plurality of sample streams and enables them to combine into a single ion stream that may be introduced as a single gas stream expansion into the second chamber.

18 Claims, 4 Drawing Sheets

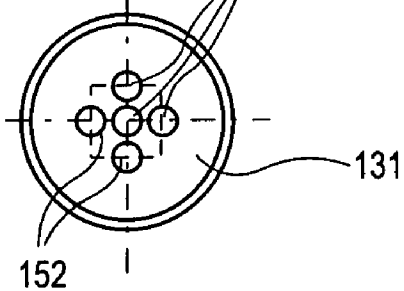
FIG. 8A
FIG. 8B
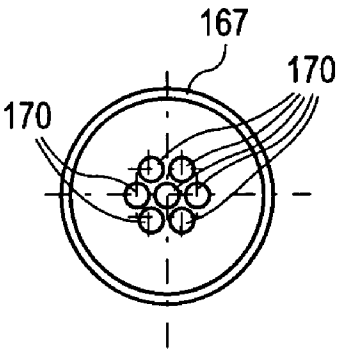
FIG. 8C
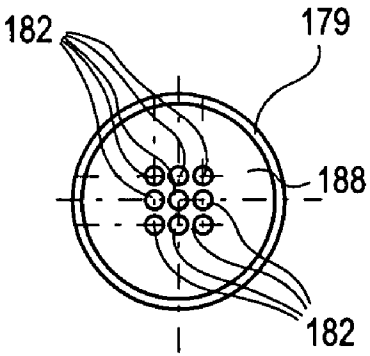
FIG. 8D

PLURAL BORE TO SINGLE BORE ION TRANSFER TUBE

BACKGROUND OF THE INVENTION

1. Field of the Invention

This invention generally relates to an ion source for a mass spectrometer, and more specifically to an ion transfer tube for transporting ions between regions of different pressure in a mass spectrometer.

2. Description of Related Art

Ion transfer tubes, also referred to as capillaries, are well-known in the mass spectrometry art for transporting ions from a spray chamber, which typically operates at or near atmospheric pressure, to a region of reduced pressure. Generally described, an ion transfer tube typically consists of a narrow elongated conduit having an inlet end open to the spray chamber, and an outlet end open to the reduced-pressure region. Ions formed in the spray chamber (e.g., via an electrospray ionization (ESI) or atmospheric pressure chemical ionization (APCI) process), together with partially desolvated droplets and background gas, enter the inlet end of the ion transfer tube, traverse its length under the influence of the pressure gradient, and exit the outlet end as a supersonic expansion. The ions subsequently pass through an aperture in a skimmer cone through regions of successively lower pressures and are thereafter delivered to a mass analyzer for acquisition of a mass spectrum. The ion transfer tube may be heated to evaporate residual solvent (thereby improving ion production) and to dissociate solvent-analyte adducts.

The number of ions delivered to the mass analyzer (as measured by peak intensities or total ion count) is partially governed by the flow rate through the ion transfer tube. It is generally desirable to provide relatively high flow rates through the ion transfer tube so as to deliver greater numbers of ions to the mass analyzer and achieve high instrument sensitivity. The flow rate through the ion transfer tube may be increased by enlarging the tube bore (inner diameter). However, increasing the cross-sectional area through which the ions and gas are transported has a detrimental effect on the efficiency of heat transfer to the ion/gas flow. Enlargement of the ion transfer tube beyond a certain point achieves no further gains in sensitivity, because the benefit produced by increased flow rate is offset by significantly reduced desolvation/adduct dissociation rates. Of course, the heat transfer to the ion/gas flow may be increased by raising the tube wall temperature, but the maximum temperature at which the tube may be operated will be limited by material considerations, as well as the tendency of certain analyte molecules to undergo thermal dissociation.

U.S. Pat. Nos. 6,583,408 and 6,803,565 by Smith et al. disclose a mass spectrometer having a parallel arrangement of multiple heated capillaries for transporting ions from an ESI spray chamber to an ion funnel. The multiple capillary configuration enables both high flow rates and good heat transfer efficiencies. However, the ion/gas flows emerge from the exit ends of the capillaries as a geometrically complex set of multiple expansions, which (although suitable for use with the ion funnel) could not be easily interfaced to a conventional skimmer structure having a single aperture.

U.S. Pat. Application No. 2006/0186329 by Gebhardt et al. discloses an ion inlet of an ion source for a mass spectrometer having a multichannel plate that functions similar to the multiple heated capillaries of the Smith patents described above. That is, the multiple channels in the multichannel plate receive and guide ions and background gas and provide a large area entrance from the source into an ion funnel. Also in this case, the multichannel plate could not be easily interfaced with a conventional skimmer structure having a single aperture.

Another consideration is that with increased wall surface area in a multiple capillary or multichannel arrangement, more ions will be lost due to discharge when they come into contact with the wall surface area.

In view of the foregoing discussion, there is a need for an ion transfer tube that enables high flow rates while maintaining good heat transfer efficiency, and is capable of being interfaced to a conventional skimmer or similar structure.

SUMMARY OF THE INVENTION

In a simple form, a first embodiment of the invention includes a spray probe for introducing a spray of droplets of a sample solution into a first chamber and an ion transfer tube extending between the first chamber and a second chamber maintained at a reduced pressure relative to the first chamber. The ion transfer tube includes a first segment, and a second segment connected to the first segment. The first segment has an inlet end opening to the first chamber and the second segment has an outlet end opening to the second chamber. The first segment has a plurality of channels such that ions generated from the droplets are divided among the plurality of channels as the ions flow through the first segment. It is to be understood that the plurality of channels may be substantially parallel or may have other orientations relative to each other. The second segment has a common channel in fluid communication with each of the plurality of channels. The common channel may thus receive and carry a combined ion flow from the plurality of channels in the first segment. The ion transfer tube may have a heater structure associated therewith for heating at least a portion of the first segment in order to evaporate residual solvent flowing together with any associated gases through the ion transfer tube.

By dividing the ion flow among a plurality of channels in the first segment of the ion transfer tube, high ion/gas flow rates may be obtained without having a substantial adverse effect on heat transfer efficiency and consequent desolvation, thereby allowing relatively large numbers of ions to be delivered to a downstream mass analyzer. Further, by combining the ion/gas flow in a common channel in the second segment of the ion transfer tube, a single gas stream expansion is generated, which may be interfaced with a single aperture in a plate, or a skimmer structure.

BRIEF DESCRIPTION OF THE DRAWINGS

FIGS. 8A-8D show a side view and an end view of a variety of configurations for an insert element of the ion transfer tube of FIG. 7.

DETAILED DESCRIPTION

Figure 1:
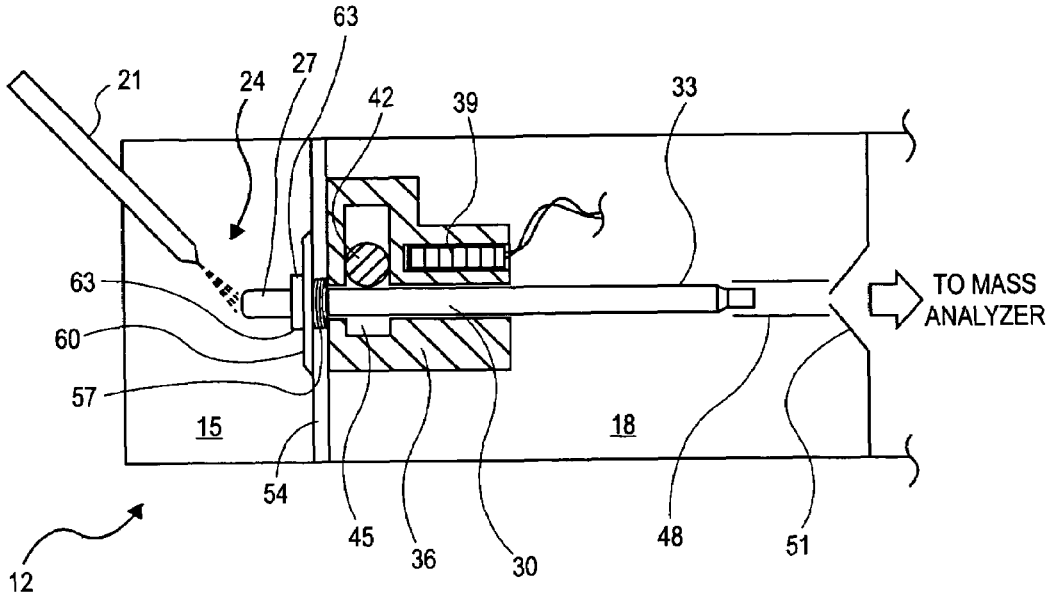
FIG. 1 is a diagrammatic and partial sectional view showing the ion source system according to an embodiment of the present invention.

FIG. 1 shows a diagrammatic and partial sectional view of an ion source 12 of a mass spectrometer. The ion source 12 includes a first chamber 15 and a second chamber 18, maintained at a lower pressure than the first chamber 15 during operation. For example and without limitation, the first chamber may be generally at atmospheric pressure while the second chamber may be at a pressure on the order of one Torr. The ion source system 12 includes a spray probe 21 supported in the first chamber in a position that directs a spray 24 of droplets of sample solution including an analyte and a solvent from a tip of the spray probe into an inlet end 27 of an ion transfer tube 30. The spray probe 21 may be an electrospray probe, in which the sample solution is directed through a spray needle maintained at an elevated potential relative to other surfaces of the first chamber 15 so as to produce a spray of electrically charged droplets, or may alternatively take the form of an atmospheric pressure chemical ionization (APCI) probe or other suitable probe that produces a spray of sample solution droplets. The probe shown and described herein is not to be limited to any particular ionization probe. Rather, it is to be understood that the probe may be any atmospheric pressure ionization (API) probe and may include, by way of several non-limiting examples, an electrospray ionization (ESI) probe, a heated electrospray ionization (H-ESI) probe, an atmospheric pressure chemical ionization (APCI) probe, an atmospheric pressure photoionization (APPI) probe, an atmospheric pressure matrix assisted laser desorption ionization (AP-MALDI) probe, and an atmospheric pressure laser ionization (APLI) probe. Furthermore, the term API probe is intended to include a "multi-mode" probe combining a plurality of the above-mentioned probe types. Any of these and other ionization sources singly or in combination can be used to produce charged particles for incorporation with the present invention. In general, the term API probe is intended to include any device that is capable of producing charged droplets or ions from a liquid or gas introduced into an API source.

The ion transfer tube 30 may be supported in one or more of the first chamber 15 and the second chamber 18. The ion transfer tube 30 is positioned so that the inlet end 27 is open to the interior of the first chamber 15. The ion transfer tube 30 also has an outlet end 33 that is open to the second chamber 18. Thus, ions, together with partially desolvated droplets and atoms or molecules of background gas (gas introduced into the first chamber 15 for nebulizing or focusing the droplets, solvent vapor, and ambient gases) are introduced into the inlet end 27 of the ion transfer tube 30, and traverse the length of the ion transfer tube 30. Thus, ions and background gas pass from the first chamber 15 at a relatively higher pressure through the ion transfer tube 30 and out the second end 33 into the second chamber 18 at a lower pressure.

The ion transfer tube 30 may be heated by a heater block 36. The heater block 36 may also be supported in the second chamber 18. The heater block may have one or more heating elements 39 thermally connected thereto for heating the heater block 39 and the ion transfer tube 30. Heating the ion transfer tube 30 in this manner during operation helps to evaporate residual solvent in partially desolvated droplets carried from the spray 24 into the ion transfer tube 30. The heater block 36 may be adapted with a bore to receive and hold the ion transfer tube 30. The heater block 36 may also be in sealed contact with an interior of the second chamber 18. The heater block 36 may include a sealing mechanism for sealing the second chamber when the ion transfer tube 30 is removed. The sealing mechanism may include a ball 42 movably supported in a recess 45 within the heater block 36 such that when the ion transfer tube 30 is removed from the second chamber 18, the ball 42 drops into sealing engagement with a seat in the recess, for example. Thus, the ion transfer tube 30 may be inserted, removed for cleaning or other purposes, and replaced without breaking the vacuum seal in the mass spectrometer. This sealing mechanism may be similar to that shown and described in U.S. Pat. No. 6,667,474 to Abramson et al., the entire specification of which is incorporated herein by reference.

Once the ions pass out of the second end 33 and into the second chamber 18, they may be focused by a tube lens 48 during a single gas stream expansion. The gas stream expansion may be interfaced with a single aperture in a plate, which may take the form of a conventional skimmer 51 as the stream proceeds toward a mass analyzer, for example.

The ion transfer tube 30 may be coupled to a wall 54 of one or both of the first and second chambers 15, 18 by threads 57 on the ion transfer tube 30 that engage in complimentary threads in the wall 54 or in a nut fixed to the wall 54. A flange 60 may be drawn into contact with the wall 54 by the threaded coupling of the threads 57 with the wall or nut. This engaging contact of the flange 60 may thus provide structural support for a coupling that has greater strength and stability. The ion transfer tube 30 may be coupled to the vacuum chambers in any conventional manner. With the ion transfer tube thus configured with both segments integrated as a mountable unit or assembly, repeatable alignment and positioning of the segments relative to each other and the overall systems is facilitated.

Figure 2:
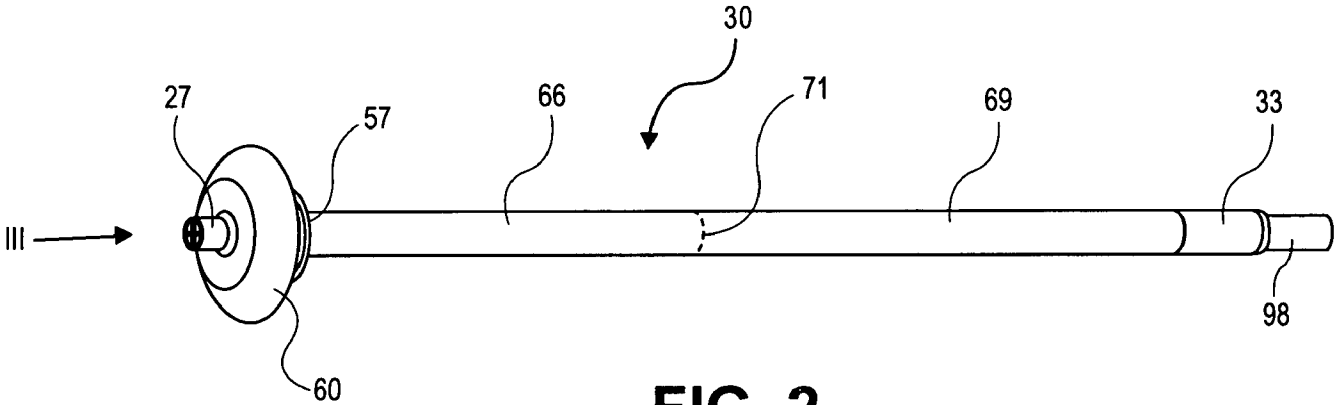
FIG. 2 is a perspective view of an ion transfer tube configured according to an embodiment of the present invention.

FIG. 2 is a perspective view of the ion transfer tube 30 of FIG. 1. The ion transfer tube 30 may be generally divided into first and second portions with a boundary at some point along a length of the ion transfer tube 30. The first and second portions may include respective inlet and outlet ends 27, 33. Alternatively, these portions may be identified as first and second segments 66, 69 that may correspond to opposite sides of an identifiable junction as indicated by a dashed line 71. In this regard, the ion transfer tube 30 may be formed of at least two pieces that are joined at an intermediate location along a length of the ion transfer tube such as at 71. Alternatively, the ion transfer tube may have a one-piece outer tube that includes both of the first and second segments 66, 69, and the first and second segments 66, 69 may be identified by their respective internal structure and/or function that will be described in greater detail with regard to FIGS. 3-6 below.

Figure 3:
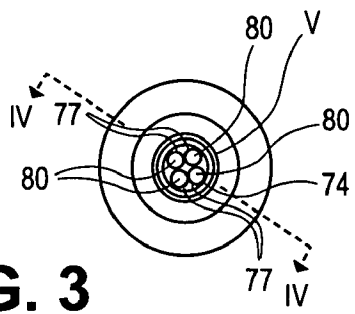
FIG. 3 is an end view of the ion transfer tube of FIG. 2 taken in a direction of arrow III of FIG. 2.

FIG. 3 is an end view of the ion transfer tube 30 taken in a direction of arrow III in FIG. 2. As shown, the ion transfer tube 30 may have an outer sleeve 74 and a plurality of capillary tubes 77 inside the outer sleeve 74.

Figure 4:
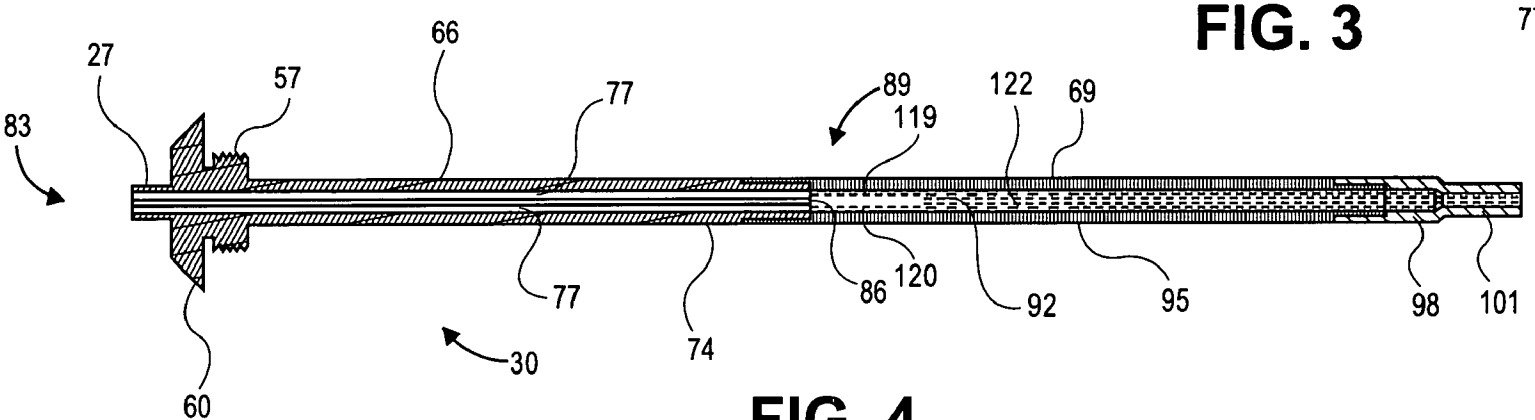
FIG. 4 is a sectional view of the ion transfer tube of FIGS. 2 and 3 taken along line IV-IV of FIG. 3.

FIG. 4 is a sectional view taken along line IV-IV of FIG. 3. As may be appreciated from FIGS. 3 and 4, the capillary tubes 77 may form a plurality of channels 80 that extend through the inlet end 27 and form an inlet 83. The plurality capillary tubes 77 and associated channels 80 also extend through the first segment 66 and out through an outlet end 86 of the first segment 66. The first segment outlet end 86 forms part of a transition 89 between the first and second segments 66, 69. It is to be understood that fluid flow from the first segment 66 through the transition 89 and into the second segment 69 also undergoes a transition from flow as a plurality of streams to a combined stream in a common channel 92. The common channel 92 may be formed by a portion of the outer sleeve 74 that surrounds the capillary tubes 77. That is, a portion of the outer sleeve 74 may be extended beyond the outlet end 86 of the first segment 66 to form the common channel 92. Alternatively, the common channel 92 may be formed by a second segment tube 95 that is connected to the outer sleeve 74 generally at the outlet end 86, as shown in FIG. 4.

Conductance in all embodiments is dependent on length, cross sectional flow area (which depends on diameter for round capillaries/tubes), and temperatures in the plurality of channels of the first segment and the common channel of the second segment. Flow and throughput are dependent on conductance and a pressure differential between the inlet and outlet for the transfer tube. In one embodiment the conductance in the second segment is to be greater than or equal to the sum of the conductances in the first segment. It is to be understood that one having ordinary skill in the art would be capable of generally calculating the needed lengths, cross sectional flow areas, and temperatures for each of the first and second segments in order to yield a desired flow across a selected pressure differential.

FIGS. 2 and 4 also show a tip 98 connected to the second segment tube 95 and forming part of the second segment 69. The tip 98 shows a constricted portion 101 relative to the channel 92. It is to be understood that the tip 98 and/or constricted portion 101 are optional. The parameters of the segments and portions thereof may be selected such that the conductance in the second segment 69 is greater than or equal to conductance in the first segment 66. Otherwise, when the tip 98 is incorporated for example, the constricted portion 101 may be controlling or yield the smallest conductance of any portion of the second segment 69 or even of the overall transfer tube 30. Thus, a degree of constriction at the outlet end 33 of the second segment 69 may be selected so as not to limit the overall flow or throughput for the ion transfer tube 30.

It is to be understood that in another embodiment, the constriction at the tip may be purposely selected to dominate the overall conductance. Alternatively or additionally, the constriction may be provided for reasons other than controlling flow or throughput for all of the embodiments of the invention. For example, the constriction may be incorporated to provide the advantage of improving the unifying effect of the second segment 69 to form the combined stream from the plurality of streams coming from the first segment 66. Also, it is to be understood that the tip 98 may be a separate piece, or may be provided as one piece together with the outer sleeve 74 or the second segment tube 95 without departing from the spirit and scope of the invention.

Figure 5C:
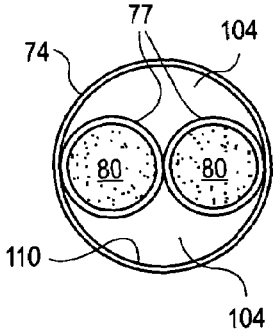
FIGS. 5A-5C are end views of region V of FIG. 3 showing a variety of configurations according the present invention.
Figure 5B:
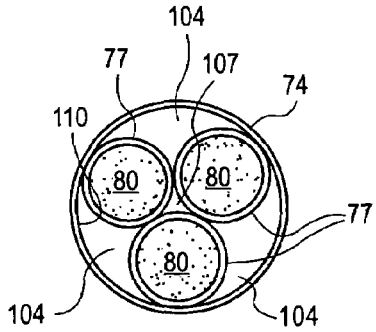
Figure 5A:
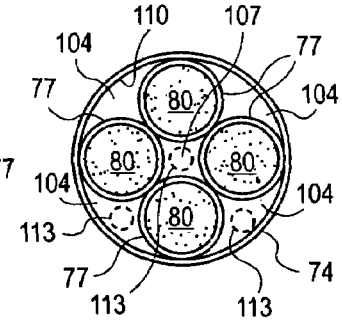

FIGS. 5A-5C are enlarged detailed end views corresponding to a region V shown encircled in FIG. 3. FIG. 5A shows a configuration in which the plural channels 80 are formed by four capillary tubes 77 supported inside the outer sleeve 74. FIG. 5B shows a configuration having three capillary tubes 77 supported within the outer sleeve 74. FIG. 5C shows a configuration having two capillary tubes 77 supported within the outer sleeve 74.

One of the advantages provided by the plurality of capillary tubes 77 within the outer sleeve 74 is that the walls of the capillary tubes increase the surface area that is in contact with a sample fluid 83 (which comprises a combination of gas and ion flow) within the channels 80 as the sample fluid 83 passes through the capillary tubes 77. Thus, the convective heat transfer from the walls of the capillary tubes 77 into the sample fluid 83 is increased. As shown in FIGS. 5A and 5B, one or more thermally conductive materials 104 may be placed in spaces between the capillary tubes 77 and the outer sleeve 74, and one or more thermally conductive materials 107 may be placed in a space between the plurality of capillary tubes 77 themselves. The configuration shown in FIG. 5C has no space directly between the plurality of capillary tubes 77 for placement of additional heat conductive material. The heat conductive material may include metallic solids 104, 107, which may include braze material for holding the capillary tubes 77 to an inner wall 110 of the outer sleeve 74 and/or solid rods 113 for insertion in spaces between the capillary tubes and the outer sleeve 74, as shown by dashed lines in FIG. 5A. The braze material and/or solid rods 113 have the advantage of closing the spaces between the capillary tubes 77 and the inner wall 110 to form a vacuum seal. Thus, in this embodiment, the only flow channels between the first and second chambers 15 and 18 are the channels 80. The solid rods 113 also have the advantage of aiding in spreading the braze material to more surface area between the inner surface 110 of the sleeve 74 and the capillary tubes 77 for improved heat conduction.

Another advantage of the outer sleeve 74 receiving and supporting the capillary tubes 77 is that the combination of the inner capillary tubes 77 and the outer sleeve 74 forms a strong and rigid ion transfer tube that has the needed structural integrity to maintain alignment during assembly and installation of the ion transfer tube 30 in the ion source and mass spectrometer. Each of the added materials 104, 107, 113 further serves to structurally strengthen ion transfer tube 30. Among other things, the ion transfer tube 30 is thus made strong enough to engage the ball 42 and move it away from a seated, sealed position without bending or other adverse effects on the ion transfer tube 30 when the ion transfer tube is inserted initially or after cleaning. Thus, very thin walled capillary tubes may be incorporated for the further advantage set forth below. It is to be understood that insertion and removal of the ion transfer tube 30 in this manner may be accomplished without breaking the vacuum seal.

In an alternative or additional expression of the advantageous structure of the present invention, the walls of the capillary tubes extend radially inwardly relative to the inner surface 110 of the outer sleeve 74 that would otherwise form a single channel in the first segment 66. That is, the walls extend to a central location within a perimeter of the path of the gaseous sample fluid 83. In ion transfer tubes without the benefits of the capillary tubes of the present invention, portions of the sample fluid 83 in a boundary layer near the inner walls of the outer sleeve 74 would form an insulative layer gas through which heat would have to be convectively transferred in order to reach centrally located portions of the fluid 83. Thus, the boundary layer would actually insulate the centrally located portions of the gaseous sample fluid 83 against heat transfer. This is an increasing concern as the ion transfer tube diameter is increased in an effort to increase throughput, as will be described below. On the other hand, with the capillary tubes 77, heat may be conductively transferred along and through walls of the capillary tubes 77 to a central region within the outer sleeve 74 of the ion transfer tube 30. Thus, more of the sample fluid 83 can be heated more effectively by providing capillary tubes within the outer sleeve 74.

One of the considerations in configuring the ion transfer tube 30 is that areas outside of the capillary tubes may not contribute to the flow or throughput. These areas may be considered dead spaces. If a large dead space is located at a center of the outer sleeve, then a large loss of flow or throughput may be the result. Hence, a configuration with minimal dead space may be utilized. To further lessen the loss of flow and throughput, the capillary tubes 77 may be provided with thin walls.

Figure 6:
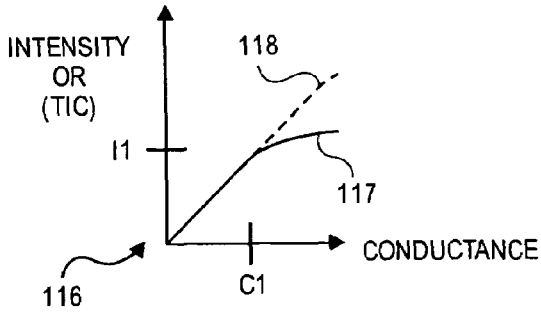
FIG. 6 is a graph showing a comparison of the variation of total ion count (TIC) with ion transfer tube conductance, both with and without the implementation of the teachings of the present invention.

FIG. 6 is a graph 116 showing the relationship of ion intensity or total ion count (TIC) along the vertical axis in relation to the increasing diameter along the horizontal axis. It is to be understood that the number of ions delivered to the mass analyzer (as represented by ion intensity or TIC) is, at least in part, a function of total sample fluid flow or throughput in the ion transfer tube 30, which is at least in part a function of conductance. However, if the flow or throughput is large at the expense of desolvation, then the increase in intensity or TIC will not be proportional to the increase in conductance and flow rate, because the number of detectable ions will not be commensurately large due to reduced heat transfer efficiency. By providing multiple channels and thus increasing the area over which heat may be transferred to the sample fluid, embodiments of the present invention enable good heat transfer and satisfactory desolvation rates over a wider range of sample fluid flow rates relative to a conventional single capillary. This advantage is illustrated by the relation between solid curve 117, which shows the variation of ion intensity or TIC with conductance in a conventional single-bore ion transfer tube, and dashed curve 118, which shows the variation of the ion intensity or TIC with conductance in ion transfer tube 30 constructed in accordance with the above-described embodiment.

From FIG. 6 it can be discerned that both curves depict an initial increase of ion intensity/TIC with increasing conductance. However, when the conductance is increased beyond a value C1 corresponding to an intensity/TIC I1, the intensity/TIC associated with the conventional ion transfer tube levels off due to decreasing heat transfer efficiency, which results in reduced desolvation and ion generation. In contradistinction, the intensity/TIC associated with ion transfer tube 30 continues to increase well beyond the value of I1 because of the enhanced heat transfer property of the multibore configuration, which allows adequate desolvation rates to be maintained over a greater range of conductances. The enhanced heat transfer properties of the multibore configuration also enable achieving higher intensities/TICs.

It is possible to provide the plurality of channels along an entire length of the ion transfer tube. However, it was discovered that doing so resulted in adverse interaction between the ion streams once they left the output end of the plurality of channels and entered the second chamber. That is, during the expansion of the relatively high pressure gas and analyte ions that occurs as they enter the second chamber, plural streams of gas and ions can interact with each other to form a complex flow geometry, resulting in a reduction in the number of ions being passed through the skimmer 71 or similar structure. On the other hand, extending the outer sleeve 74 beyond the outlet ends of the plurality of channels 80, or adding a common channel tube beyond the outlet ends as shown in FIG. 4, enables a plurality of streams 119, 120 of ions from the plurality of channels 80 to combine into a single stream 122 prior to being introduced into the second chamber 18. Thus, a unitary jet expansion is formed, thereby allowing the ion transfer tube to be efficiently interfaced with a conventional skimmer lens or similar structure having a single aperture.

Figure 7:
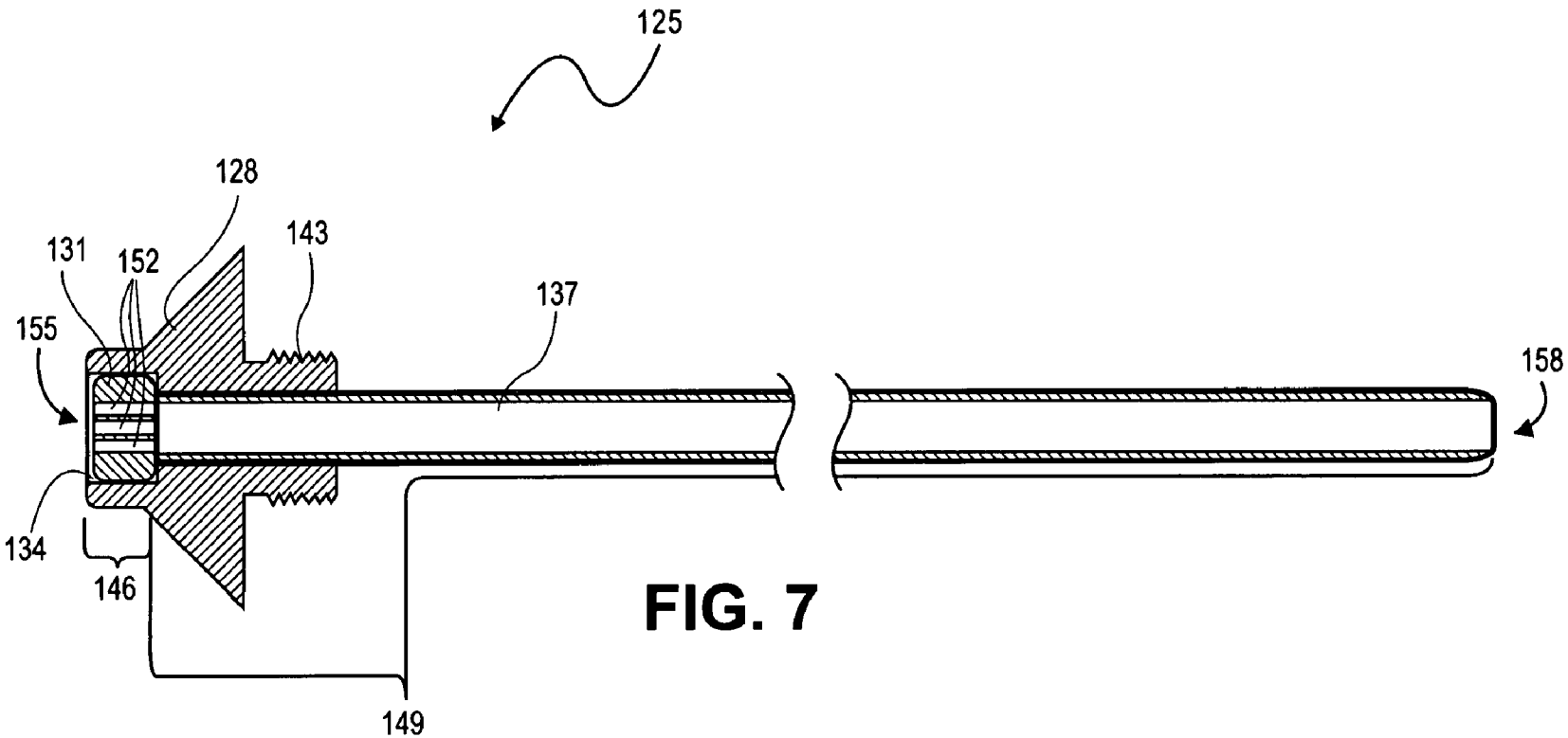
FIG. 7 is a sectional view analogous to that of FIG. 4 of an ion transfer tube in accordance with an alternative embodiment the present invention.

FIG. 7 is a sectional view of an ion transfer tube 125 in accordance with an alternative embodiment. The ion transfer tube 125 may include a head 128, a plural channel insert 131 installed in an inlet recess 134 of the head 128, a common capillary tube 137 received into an outlet end of the head 128, and threads 143 on the head 128. The head 128, plural channel insert 131, and common capillary tube can be welded, brazed, or press fit together for a complete vacuum seal when the ion transfer tube 125 is installed in a mass spectrometer. Alternatively, two or more of these elements may be provided as one piece. The ion transfer tube 125 can be installed in a mass spectrometer in a sealed manner similar to the installation of the ion transfer tube 30 described above.

Analogous to the embodiments of FIGS. 1-5C, the ion transfer tube 125 includes a first portion or first segment 146 and a second portion or segment 149. The first segment 146 has a plurality of bores 152 forming a respective plurality of channels analogous to the plurality of channels formed by the plurality of capillaries in the embodiment of FIGS. 1-5C. Thus, the first segment 146 has an inlet end 155, and the second segment 149 has an outlet end 158. A transition occurs downstream of the first segment 146, in an inlet portion of the second segment 149. The transition may be defined to correspond with the actual transition of the sample fluid as it changes from plural streams leaving the first segment 146 to a single unified common stream somewhere along a length of the second segment 149.

The second segment 149 may be considered to include a portion of the head 128 that receives the common capillary tube 137, and thus the second segment 149 may be directly connected to the first segment 146. The common capillary tube 137 may be abutted with or otherwise connected to the plural channel insert 131 for a direct connection between the first and second segments analogous to the embodiment of FIGS. 1-5C. In the embodiment of FIG. 7, a separate or integral tip having a constriction may be applied to an outlet end of the ion transfer tube 125. In all of the embodiments of the invention it is to be understood that additional elements could be added to the inlet or outlet ends without departing from the spirit and scope of the invention. For example without limitation, a structure of the head 128 or insert 131 that forms an enlarged inlet opening upstream of the plurality of bores 152 may provide an advantageous element that aids in guiding the gaseous sample fluid and ions into the ion transfer tube 125.

FIG. 8A shows a side view of the plural channel insert 131 separated from the head 128. As may be appreciated, the insert may be sized for receipt in the recess 134. The insert 131 may be fixed and sealed to the head 128 by any known method, which may include laser or e-beam welding for example. FIG. 8B is an end view showing the plurality of bores 152 in a cross configuration.

FIG. 8C is an end view of a plural channel insert 167 similar to the end view of FIG. 8B. However, a plurality of bores 170 in insert 167 are more numerous, and are in a generally hexagonal configuration. The size of the bores 170 may be decreased as the number of bores 170 is increased. On the other hand, increased throughput may be realized by maintaining or increasing the size and increasing the number of bores 170. A thickness of the material may be selected to define a length of the bores 170. The plural channel insert 167 may be formed of Titanium in order to incorporate its excellent heat transfer properties.

FIG. 8D shows an end view of a plural channel insert 179 having a still further different configuration of the plurality of bores 182. As shown, the plurality of bores are in a generally square pattern with a further increase of the number of plurality of bores 182 to nine. Once again, the size of the bores 182 may be smaller and the number of the bores 182 is greater than those in the embodiments of FIGS. 8A-8C. On the other hand, the size of the bores 182 may be kept the same or increased with an increased number of bores 182. Thus, the heat transfer can be further improved. The length of the bores 182 may be determined by selecting the thickness of the insert 179.

In the embodiments of FIGS. 7-8D, the plural channel inserts 131, 167, 179 may be thin or plate like so that a length of the plurality of bores through the plural channel inserts will be short. Similar configurations could be applied to the embodiments of FIGS. 1-5C. With a plate-like structure forming the plurality of channels in the first segment, a greater number of channels may be formed. For example without limitation, one range of the number of channels may be from two to ten. However, a number many times greater than any number in the range may be incorporated without departing from the scope of the invention. The plurality of channels in each of the embodiments may be substantially parallel to each other or may incorporate any of a variety of other relative positions. For example, but without limitation, the plurality of channels may be inclined radially inward toward a central axis or may be helically oriented to provide flow of the gaseous sample fluid and ions in a helix.

The same advantages of increased throughput or TIC without the detrimental effects of reduced desolvation can be achieved with the ion transfer tubes 125 of FIGS. 7-8D similarly to that which can be achieved with the ion transfer tubes 30 of FIGS. 1-5C. The increased TIC with increased conductance depicted in the graph of FIG. 6 applies to the embodiments shown in FIGS. 7-8D as well as to the embodiments of FIGS. 1-5C. Elements from all of the embodiments disclosed herein may be mixed and matched in any combination without departing from the spirit and scope of the invention. Also, it is to be understood that the matching and/or selecting of conductances in the respective portions or segments of the ion transfer tube 125 of FIGS. 7-8D can be applied in the same ways described above with regard to the embodiments of FIGS. 1-5C.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise forms disclosed. Many modifications and variations are possible in light of the teachings above without departing from the spirit and scope of the forthcoming claims. For example, walls may be of any shape and may be extended radially inwardly from an inner wall of an ion transfer tube in order to form any plurality of channels or to provide conductive heat transfer to portions of the sample fluid that would otherwise be more remote from a heater block or some other heat source used to enhance desolvation.

Any number of capillary tubes may be provided in the first segment. For example without limitation, the number of capillary tubes may be five, six, seven, or eight. The number and relative orientations of capillaries may be selected depending on ion spray characteristics and geometries. For example, an elongate plume from a particular ion spray probe would interface well with a linear array of capillary tubes in the ion transfer tube. The ion spray characteristics of a sample may also call for other changes such as lower temperatures and less heat transfer from the heater block, for example. Lengths of the individual capillary tubes and the length of the overall ion transfer tube may be selected based on different characteristics/specifics of the sample or different pressure differentials between the first and second chambers. The length of the ion transfer tube over which the sample is heated may be selected based on flow characteristics and other sample characteristics such as ionization state.

It is to be understood that the flow characteristics may be different for different charge states of the same sample, whether the charge states are single or any of a variety of multiple charges per ion. Furthermore, some analyte compounds may interact more with the walls of the channels and result in greater loss of ions per length of the channels due to discharge. As such, there is a benefit in incorporating the common channel of the second segment as is done in the embodiments of the present invention. The benefit is that the surface area per unit length in the second segment is less than the surface area per unit length in the first segment such that there will be less discharge of the ions per unit length in the second segment than in the first segment.

The length of the first segment or the plural bore portion of the ion transfer tube may be small or large in comparison to the overall length of the ion transfer tube. This relationship may be expressed in terms of a ratio of the length of the first segment (or plurality of bores) to the overall length. For example, in an ion transfer tube having a length of one hundred millimeters, a short first segment could have a length of three fourths of a millimeter in a direction of flow. Thus, the ratio could be expressed as 0.0075. In one broad range, the ratio may be from 0.002 to 0.95. It is to be understood that the ratio of the first segment or plurality of bores to the overall length of the ion transfer tube may have any intermediate ratio including, but not limited to, one eighth, one fourth, one third, one half, two thirds, and three fourths. The embodiments of FIGS. 7-8F provide ratios at the lower end of this range since the length of the first segment or plurality of bores is formed by apertures that have a relatively short length through an element that is to be installed in a head of the ion transfer tube at the inlet end of the ion transfer tube as described above.

Many of the exemplary embodiments of the figures show round capillaries, round ion transfer tube segments, and generally circumferential distributions of capillary tubes. However, it is to be understood that the shapes of the capillary tubes and/or ion transfer tubes need not be round. These shapes may include elliptical, square, triangular, or any other shape. The distribution of the capillary tubes need not be circumferential. Furthermore, the sizes and/or shapes of the capillary tubes in any given ion transfer tube may vary. Still further, the capillary tubes may be positioned in any symmetrical or nonsymmetrical way about a central axis of the ion transfer tube. Still further, the capillary tubes may form a linear or curved array, or may be distributed in a rectangular or hexagonal distribution with horizontal or diagonal rows at any desired angle. A seven capillary tube arrangement having six capillary tubes surrounding a central capillary tube is also contemplated.

The capillary tubes, outer sleeves, heads, and inserts may also include any of various materials. For example, one or more of these elements may be formed of Titanium, stainless steel, brass, or other metal, ceramic or composite material. Titanium and brass have the advantage of being good heat conductors. In one embodiment, the capillary tubes may be formed as grooves or drilled holes in a block of silicon nitride or other ceramic material. Thus, heaters may be embedded directly into the block. In one embodiment, grooves may be provided in a surface of a first block, and a second block may be added on top of the first block to close the grooves and form the capillary channels. A variety of surface characteristics on inner walls of the capillary tubes may be incorporated. For example, a less smooth surface that causes turbulence in boundary layers of the sample may actually result in less interaction between streams of the sample that are exiting a first segment of an ion transfer tube. For the silicon nitride ceramic or other examples having an array or other configuration of capillary tubes, the plume from the ion probe could be configured to have a corresponding flat or other configuration, such as by shaping with gas streams.

What is claimed is:

1. An ion source for a mass spectrometer, comprising:

a spray probe for introducing a spray of droplets of a sample solution into a first chamber;

an ion transfer tube extending between the first chamber and a second chamber maintained at a reduced pressure relative to the first chamber, the ion transfer tube comprising:

a first segment and a second segment connected to the first segment;

the first segment including an inlet end opening to the first chamber and the second segment including an outlet end opening to the second chamber;

the first segment having a plurality of separate and substantially parallel channels such that ions generated from the droplets are divided among the plurality of channels as the ions flow through the first segment;

the second segment having a common channel in fluid communication with each of the plurality of channels, the common channel receiving and carrying a combined ion flow from the plurality of channels in the first segment; and a heater structure for heating at least a portion of the first segment to evaporate residual solvent flowing through the ion transfer tube.

2. The ion source of claim 1, wherein each of the plurality of channels of the first segment has a respective channel conductance and the second segment has a single common channel conductance; and the single common channel conductance of the second segment is substantially equal to or greater than a sum of the respective channel conductances of the first segment.

3. The ion source of claim 2, wherein the ion transfer tube further comprises a tip on the second segment, the tip providing a maximum conductance limit for the single common channel of the second segment, wherein the common channel conductance of the second segment is approximately equal to the sum of the respective channel conductances of the first segment.

4. The ion source of claim 1, wherein each of the plurality of channels of the first segment has a respective channel conductance and the second segment has a single common channel conductance; and the single common channel conductance of the second segment is less than a sum of the respective channel conductances of the first segment.

5. The ion source of claim 1, wherein the first segment comprises a plurality of capillary tubes supported within an outer sleeve, each capillary tube defining a corresponding one of the plurality of channels of the first segment, the plurality of capillary tubes being thermally associated with each other and the outer sleeve by at least one heat conductive material.

6. The ion source of claim 5, wherein the second segment comprises at least a portion of the sleeve.

7. The ion source of claim 5, wherein the at least one heat conductive material comprises a braze material, the braze material further providing a fluid seal between an exterior of the capillaries and an inner surface of the sleeve.

8. The ion source of claim 5, wherein the first segment has five capillary tubes.

9. The ion source of claim 1, wherein the spray probe is an electrospray probe.

10. The ion source of claim 1, wherein the spray probe is an APCI probe.

11. An ion transfer tube for transporting ions from a first chamber to a second chamber of a mass spectrometer, the ion transfer tube comprising:

a first segment and a second segment connected to the first segment;

the first segment including an inlet end opening to the first chamber and the second segment including an outlet end opening to the second chamber, the second chamber being maintained at a reduced pressure relative to the first chamber;

the first segment having a plurality of separate and substantially parallel channels such that ions flowing through the first segment are divided among the plurality of channels;

the second segment having a common channel in fluid communication with the plurality of channels of the first segment, the common channel receiving and carrying a combined ion flow from the plurality of channels in the first segment; and a heater structure for heating at least a portion of the first segment to evaporate residual solvent flowing through the ion transfer tube.

12. The ion transfer tube of claim 11, further comprising a transition between the plurality of channels of the first segment and the common channel of the second segment, wherein:

each of the plurality of channels of the first segment has a respective channel conductance and the common channel of the second segment has a common channel conductance; and the common channel conductance of the second segment is substantially equal to or greater than a sum of the respective channel conductances of the first segment.

13. The ion transfer tube of claim 12, further comprising a tip on the second segment, the tip providing a maximum conductance limit for the common channel of the second segment, wherein the common channel conductance of the second segment is approximately equal to the sum of the respective channel conductances of the first segment.

14. The ion transfer tube of claim 11, wherein the first segment comprises a plurality of capillary tubes supported within an outer sleeve, the plurality of capillary tubes being thermally associated with each other and the sleeve by at least one heat conductive material.

15. The ion transfer tube of claim 14, wherein the second segment comprises at least a portion of the sleeve.

16. The ion transfer tube of claim 14, wherein the at least one heat conductive material comprises a braze material, the braze material further providing a fluid seal between an exterior of the capillaries and an inner surface of the sleeve.

17. The ion transfer tube of claim 11, wherein the first segment comprises titanium.

18. The ion transfer tube of claim 11, wherein the heater structure has a sealing mechanism for forming a vacuum seal in a mass spectrometer when the ion transfer tube is removed from the heater structure such that the vacuum seal remains unbroken when the ion transfer tube is removed from the mass spectrometer for cleaning or between uses.

* * * * *